United States Patent [19]

Schmidt

[11] Patent Number: 4,754,788

[45] Date of Patent: Jul. 5, 1988

[54] CHUCK FOR A VENEER LATHE

[76] Inventor: Charles J. Schmidt, P.O. Box 757, Diboll, Tex. 75941

[21] Appl. No.: 92,980

[22] Filed: Sep. 4, 1987

[51] Int. Cl.[4] ..... B27L 5/00; B27C 7/04

[52] U.S. Cl. ..... 144/209 R; 76/DIG. 3; 76/101 R; 82/40 R; 142/53; 142/55; 279/1 A

[58] Field of Search ..... 82/40 R; 144/209 R, 144/209 A; 76/101 R, DIG. 3; 142/53, 55; 279/1 A

[56] References Cited

U.S. PATENT DOCUMENTS

| | | | |
|---|---|---|---|
| 3,513,891 | 5/1970 | Heth | 144/209 R |
| 4,141,397 | 2/1979 | Schmidt | 144/209 R |
| 4,531,435 | 7/1985 | Walser | 144/209 R |

*Primary Examiner*—W. Donald Bray
*Attorney, Agent, or Firm*—Fulbright & Jaworski

[57] ABSTRACT

A four-bladed chuck for attachment to a drive spindle of a veneer lathe. The blades include a first flat side for providing a driving area and a second side in a plane perpendicular to the first side of an adjacent blade. The bottom of the second side extends outwardly from the chuck at the outside of the chuck providing an uprise at the outside of the chuck for holding an end of the log for reducing splitting of the log end and holding a split log together. The plane of the second side is approximately 15 degrees relative to the longitudinal axis for reducing splitting. The blades in the uprise are shaped and formed by circular end mill cutter or by casting.

5 Claims, 2 Drawing Sheets

CHUCK FOR A VENEER LATHE

BACKGROUND OF THE INVENTION

It is well known to support logs with a plywood lathe chuck for cutting veneer from the logs from the outer diameter thereof in which the ends of the logs are supported by chucks attached to the rotary spindles of the lathe. One type of chuck is shown in U.S. Pat. No. 4,141,397. While such a chuck was generally satisfactory, the six wedge-shaped blades have a tendency to cause the ends of a wood log to split as the chucks are driven into the ends of the log thereby failing to securely grip the logs while cutting the veneer and also reducing the value of the resultant core.

The present invention is directed to a four-bladed chuck which, while having a sufficient driving area and strength, reduces the tendency of the chuck to split the ends of the log by utilizing thin blades, that displace less wood, and a bottom uprise which coacts with the blades to grip the ends of the logs, reduces the possibility of their extruding and splitting and also tends to hold a split log together.

SUMMARY

The present invention is directed to a chuck for attachment to a drive spindle of a veneer lathe in which the chuck has first and second ends and means are connected to the first end for releasably fastening the chuck to a drive spindle. The second end of the chuck includes four blades in which each of the blades extends from the longitudinal axis of the chuck radially outward to the outside of the chuck and also extend outwardly from the second end of the chuck. Each of the blades includes a first flat side on the leading face of the blade in the direction of rotation thereby providing a driving area. The second side of each of the blades extends from its outer edge at an angle to the first side and is in a plane perpendicular to the plane of an adjacent blade. The bottom of each second side of the blades extends outwardly from the second end of the chuck at the outside of the chuck providing an uprise at the outside of the chuck for holding the end of the log between the uprise and the second side of the chuck blade for reducing splitting of the log end and/or holding a split log together.

Still a further object of the present invention is wherein the plane of the second side of a blade is approximately 15 degrees relative to the first side of the blade for reducing the splitting of the end of a log as the blade is driven into the log end.

Still a further object of the present invention is wherein the bottom of the second side includes a circularly shaped portion with the concave side directed outwardly from the second end.

Yet a still further object of the present invention is wherein the uprise is at an angle of approximately 45 degrees to the outside of the chuck.

A still further object of the present invention is the method of making a chuck by casting a chuck of one size, and cutting off a desired circumferential area of the chuck to provide one of the desired size while still leaving an uprise. This method allows a single casting to be made in which a plurality of sizes of chucks may be provided.

Other and further objects, features and advantages will be apparent from the following description of the presently preferred embodiment of the invention, given for the purpose of disclosure and taken in conjunction with the accompanying drawings.

DESCRIPTION OF THE PREFERRED EMBODIMENT

Figure 1:
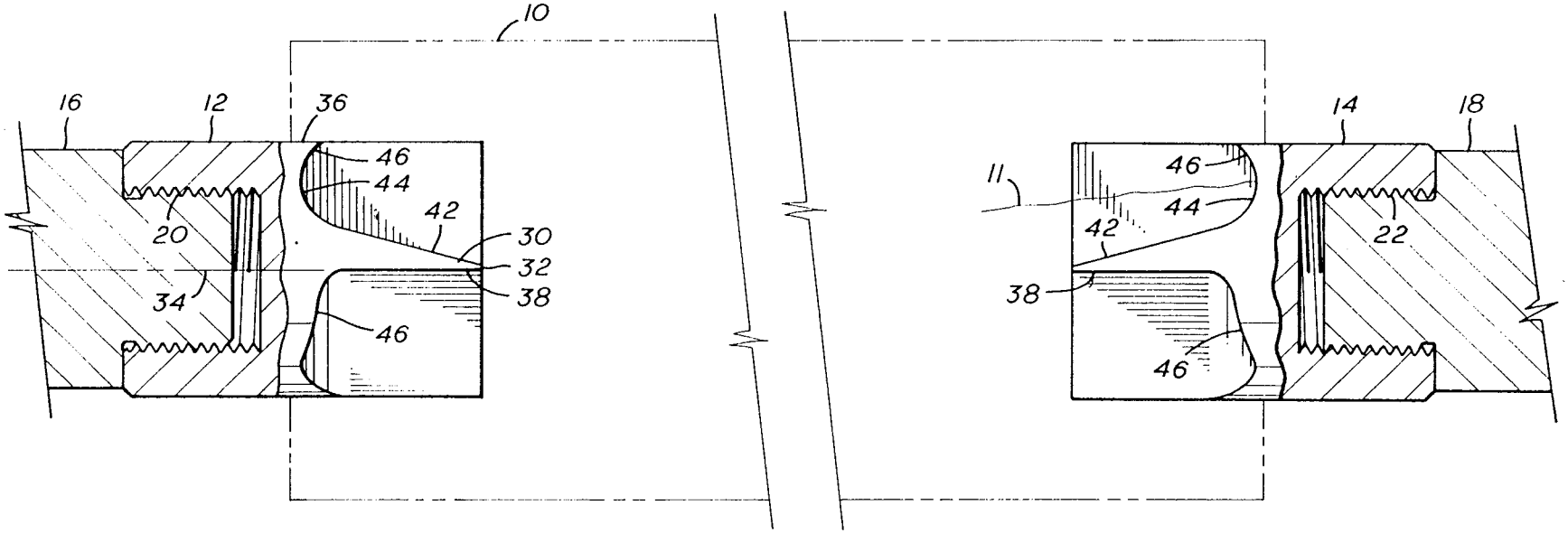
FIG. 1 is an elevational view, partly in cross section, illustrating a log being held between two chucks of the present invention.

Referring now to the drawings, and particularly to FIG. 1, a wood log 10, shown in dotted outline, is secured between a right-hand chuck 12 and a left-handed chuck 14 in a conventional plywood veneer lathe. Each of the chucks 12 and 14 are supported from a drive spindle such as drive splindles 16 and 18, respectively. As described in U.S. Pat. No. 2,879,816, the drive spindles 16 and 18 are axially extended, such as by hydraulic cylinders, to drive the chucks 12 and 14 into opposite ends of the log 10 and are thereafter rotated and plywood veneer is peeled from the outer circumference of the log 10. The right-handed chuck 12 and the left-handed chuck 14 are identical except for the direction of the blades thereon.

The chucks 12 and 14 have first and second ends and means are provided for connecting the first ends of the chucks 12 and 14 to the drive spindles 16 and 18, respectively, such as by threads 20 and 22, respectively.

The second ends of each of the chucks 12 and 14 include four blades 30 each of which has an outer edge 32 extending from the longitudinal axis 34 of the chuck radially outward to the outside or periphery 36 of the chuck thereby providing an engaging edge for biting into and securely holding the ends of the log 10. Each of the blades 30 includes a first flat side 38 longitudinally extending from its outer edge 32 towards the first end of the chuck. The flat sides 38 of the blades 30 are positioned on the leading face of the blades 30 in their direction of rotation, such as 40 for the chuck 12, thereby providing a large driving area between the chucks 12 and 14 in the log 10. It is therefore noted that the flat sides 38 are on one side of the blades 30 for the right-handed chuck 12 and are on the opposite sides of the blades 30 for the left-handed chuck 14. The blades 30 include a second side 42 extending from its outer edge 32 towards the first end of the chucks and at an angle to the first side 38 and are in a plane perpendicular to the plane of the adjacent blades 30. Preferably, the angle of the second side 42 to the first side 38 is a small angle, such as 15 degrees, for displacing less wood to reduce the wedging and splitting action of the blades 30 as they are inserted into the ends of the log 10.

The bottoms of the second sides 42 preferably include a circular shaped portion 44 and an outwardly extending portion which extends outwardly from the second end of the chuck at the outer periphery 36 to provide an uprise 46 at an angle to the outside or periphery 36 of the chuck, for example, 45 degrees. The uprise 46 is particularly important for engaging and holding the end of a log 10 between the uprise 46 and the second side 42 for reducing splitting of the ends of the log 10. That is, the uprise 46 engages the end of the log 10 and prevents it from extruding from the side 42 and reduces the tendency of the ends of the logs 10 from splitting and tends to hold a split 11 or cracked log together as veneer is being peeled from the log 10.

The blades 30 and uprises 46 and the second ends of the chucks may be suitably formed by an end mill cutter, such as one having a one inch diameter.

Figure 2:
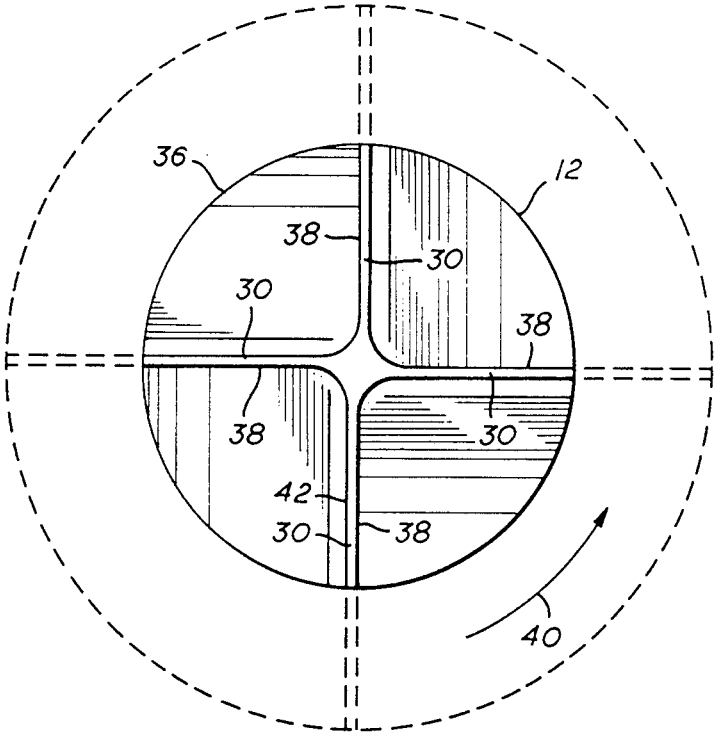
FIG. 2 is an elevational end view of one of the chucks shown in solid lines which can be made from a larger chuck which includes the dotted outline.
Figure 3:
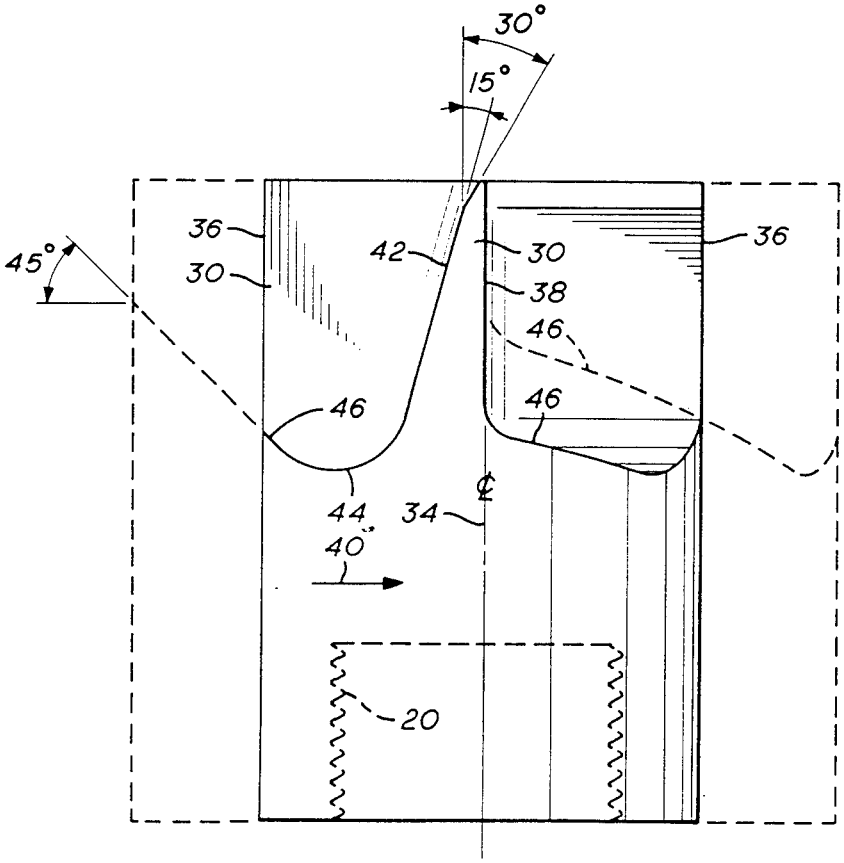
FIG. 3 is an elevational side view of the chuck of FIG. 2.

However, the preferable method, for manufacturing economy, of manufacturing the chucks 12 and 14, as best seen in FIGS. 2 and 3, is to cast a single size chuck, as shown in dotted outline, of the maximum desired size. That is, chucks may be provided in various diameter sizes such as 4½ inches, 4 inches, 3¼ inches, 3 inches, and 2¾ inches. The second end of the casting will include the blades 30 and the configurations previously described and shown. Thereafter, the outer circumference of the casting may be cut to reduce the casting to the desired size of chuck without removing the uprise 46. For example only, the casting shown in FIGS. 2 and 3 may be 4½ inches and is cast as shown in dotted outlines. As shown in solid outline the 4½ casting has been cut down, by cutting off a desired amount of the outer circumference, to provide a chuck with an outer diameter of 2¾ inches. Therefore, by casting a single size chuck manufacturing economies may be provided as a single size casting can be cut down to provide all sizes of chucks commonly used without eliminating the effectiveness of the uprise 46.

The present invention, therefore, is well adapted to carry out the objects and attain the ends and advantages mentioned as well as others inherent therein. While a presently preferred embodiment of the invention has been given for the purpose of disclosure, numerous changes in the details of construction and arrangement of parts, will readily suggest themselves to those skilled in the art and which are encompassed within the spirit of the invention and the scope of the appended claims.

What is claimed is:

1. A chuck for attachment to a drive spindle of a veneer lathe comprising, a chuck having first and second ends, means connected to the first end for releasable fastening the chuck to a drive spindle, said second end including four blades, each of the blades extending from the longitudinal axis of the chuck radially outwardly to the outside of the chuck and also extending outwardly from the second end of the chuck, each of said blades including a first flat side being on the leading face of the blade in its direction of rotation thereby providing a driving area, and each of the blades including a second side extending from its outer edge at an angle to the first side and being in a plane perpendicular to the plane of an adjacent blade, the bottom of each second side extending outwardly from the second end of the chuck to the outside of the chuck and having an uprise at an angle to the outside of the chuck for holding the end of a log between the uprise and the second side of the blade for reducing splitting of the log end and holding a split or crack together.

2. The apparatus of claim 1 wherein the plane of the second side of a blade is approximately fifteen degrees relative to the first side of the blade.

3. The apparatus of claim 1 wherein the bottom of the second side includes a circularly shaped portion with the concave side directed outwardly from the second end.

4. The apparatus of claim 1 wherein the uprise is at an angle of approximately forty five degrees to the outside of the chuck.

5. The method of manufacturing a chuck, casting a circular chuck having first and second ends, said second end including four blades, each of the blades extending from the longitudinal axis of the chuck radially outwardly to the outside of the chuck and also extending outwardly from the second end of the chuck, each of said blades including a first flat side being on the leading face of the blade in its direction of rotation thereby providing a driving area, and each of the blades including a second side extending from its outer edge at an angle to the first side and being in a plane perpendicular to the plane of an adjacent blade, the bottom of each second side extending outwardly from the second end of the chuck to the outside of the chuck and having an uprise at an angle to the outside of the chuck for holding the end of a log between the uprise and the second side of the blade for reducing splitting of the log end, and cutting off a desired amount of the outer circumference to size the chuck to one of a desired size without destroying the effectiveness of the uprise.

* * * * *